US005799508A

United States Patent [19]

Bonaquist et al.

[11] Patent Number: 5,799,508

[45] Date of Patent: Sep. 1, 1998

[54] CRYOGENIC AIR SEPARATION SYSTEM WITH SPLIT KETTLE LIQUID

[75] Inventors: Dante Patrick Bonaquist, Grand Island; Kevin John Potempa, Amherst, both of N.Y.

[73] Assignee: Praxair Technology, Inc., Danbury, Conn.

[21] Appl. No.: 764,937

[22] Filed: Dec. 13, 1996

Related U.S. Application Data

[63] Continuation-in-part of Ser. No. 619,383, Mar. 21, 1996, abandoned.

[51] Int. Cl.[6] ..... F25J 3/04

[52] U.S. Cl. ..... 62/646; 62/654; 62/924

[58] Field of Search ..... 62/654, 646, 924

[56] References Cited

U.S. PATENT DOCUMENTS

| | | | |
|---|---|---|---|
| 3,729,943 | 5/1973 | Petit | 62/924 X |
| 4,783,209 | 11/1988 | Erickson | 62/924 X |
| 4,977,746 | 12/1990 | Grenier et al. | 62/924 X |
| 4,994,098 | 2/1991 | Agrawal et al. . | |
| 5,019,145 | 5/1991 | Rohde et al. | 62/924 X |
| 5,036,672 | 8/1991 | Rottmann . | |
| 5,098,456 | 3/1992 | Dray et al. . | |
| 5,159,816 | 11/1992 | Kovak et al. . | |
| 5,265,429 | 11/1993 | Dray . | |
| 5,275,003 | 1/1994 | Agrawal et al. . | |
| 5,365,741 | 11/1994 | Roberts et al. . | |
| 5,386,691 | 2/1995 | Bonaquist et al. . | |
| 5,398,514 | 3/1995 | Roberts et al. . | |
| 5,400,600 | 3/1995 | Grenier . | |
| 5,572,874 | 11/1996 | Rathbone | 62/924 X |

*Primary Examiner*—Christopher Kilner
*Attorney, Agent, or Firm*—Stanley Ktorides

[57] ABSTRACT

A cryogenic air separation system wherein higher pressure column kettle liquid is divided into a portion introduced directly into the lower pressure and a portion which is substantially completely vaporized to drive an argon column top condenser, enabling the vaporization of elevated pressure liquid oxygen against feed air while maximizing argon recovery.

4 Claims, 3 Drawing Sheets

CRYOGENIC AIR SEPARATION SYSTEM WITH SPLIT KETTLE LIQUID

This is a continuation-in-part of application Ser. No. 08/619,383 filed Mar. 21, 1996, now abandoned.

TECHANICAL FIELD

This invention relates generally to the cryogenic separation of air and particularly to double column systems which produce elevated pressure oxygen and which also produce argon.

BACKGROUND ART

Certain cryogenic air separation processes produce gaseous oxygen at elevated pressure by vaporizing liquid oxygen in a separate heat exchanger or in part of the primary heat exchanger by condensing an air stream. Such processes are advantageous since the pressure of the oxygen stream may be elevated by use of a relatively small cryogenic pump or by elevation change prior to its vaporization, thus reducing the size, complexity and cost of subsequent gaseous oxygen compression streams or avoiding them completely. However, the condensation of a portion of the feed air stream reduces the flow of vapor to the high pressure column of this type of air separation unit. This factor decreases the quantity of nitrogen reflux available for both the lower and higher pressure columns because the fraction of the air which is condensed is not rectified in the high pressure column. The reduction in reflux is responsible for a decrease in argon recovery of up to 25 percent for processes where air is condensed in order to boil liquid oxygen compared with processes where practically all of the air enters the high pressure column in the form of a vapor near saturation. Heretofore this problem has been addressed by reducing the flow rate of vapor rising in the rectification zone of the lower pressure column. This is accomplished by bypassing a portion of vapor from the discharge of a turbine exhausting to the lower pressure column to the waste nitrogen line. Alternatively, a portion of the vapor generated in the argon condenser, which normally enters the low pressure column, is bypassed to the waste nitrogen line. Both means are effective for restoring argon recovery; however both have the undesirable side effect of reducing the efficiency of the air separation unit with respect to oxygen production. The oxygen fraction of the bypassed stream, typically 15 to 21 percent, which would normally be separated and recovered in the gaseous and liquid oxygen product stream, is lost. Because of this, the compression and purification of additional air to meet oxygen product demand is necessary.

Accordingly it is an object of this invention to provide a cryogenic air separation system which enables the efficient production of elevated pressure oxygen while not compromising argon recovery.

SUMMARY OF THE INVENTION

The above and other objects, which will become apparent to one skilled in the art upon a reading of this disclosure, are attained by the present invention which is:

A method for producing elevated pressure oxygen comprising:

(A) condensing feed air, passing condensed feed air into a higher pressure column, and separating feed air within the higher pressure column into nitrogen-enriched fluid and oxygen-enriched liquid;

(B) passing nitrogen-enriched fluid into a lower pressure column, passing a first portion of the oxygen-enriched liquid into the lower pressure column and producing oxygen-rich liquid within the lower pressure column;

(C) passing argon-containing fluid from the lower pressure column into an argon column and producing argon-richer vapor within the argon column;

(D) condensing argon-richer vapor by indirect heat exchange with a second portion of the oxygen-enriched liquid which is substantially completely vaporized to produce oxygen-enriched vapor, and passing oxygen-enriched vapor into the lower pressure column below where the oxygen-enriched liquid is passed into the lower pressure column;

(E) withdrawing oxygen-rich liquid from the lower pressure column, increasing the pressure of the withdrawn oxygen-rich liquid, and vaporizing the pressurized oxygen-rich liquid to condense said feed air and to produce elevated pressure oxygen; and (F) recovering elevated pressure oxygen product.

As used herein the term "top condenser" means a heat exchange device which generates column downflow liquid from column top vapor. A top condenser is generally located within the column but may be physically outside the column.

As used herein, the term "feed air" means a mixture comprising primarily nitrogen, oxygen and argon, such as ambient air.

As used herein, the terms "turboexpansion" and "turboexpander" means respectively method and apparatus for the flow of high pressure gas through a turbine to reduce the pressure and the temperature of the gas thereby generating refrigeration.

As used herein, the term "column" means a distillation of fractionation column or zone, i.e. a contacting column or zone wherein liquid and vapor phases are countercurrently contacted to effect separation of a fluid mixture, as for example, by contacting or the vapor and liquid phases on a series of vertically spaced trays or plates mounted within the column and/or on packing elements which may be structured packing and/or random packing elements. For a further discussion of distillation columns, see the Chemical Engineer's Handbook fifth edition, edited by R. H. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phase is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin.

As used herein, the term "indirect heat exchange" means the bringing of two fluid streams into heat exchange relation without any physical contact or intermixing of the fluids with each other.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein, the terms "upper portion" and "lower portion" of a column means respectively that portion of the column above and below the midpoint of the column.

As used herein, the term "argon column" means a column which processes a feed containing argon and produces a product fluid having an argon concentration which exceeds that of the feed.

DETAILED DESCRIPTION

The invention enables the efficient production of elevated pressure oxygen along with high recovery of argon. This is accomplished by creating an additional distillation zone within the lower pressure column. This additional distillation zone is created by dividing the oxygen-enriched kettle liquid stream obtained from the base of the higher pressure column into two streams. The kettle liquid is divided so that the heat duty of the argon column top condenser may be supplied by substantially completely vaporizing one portion of the divided kettle liquid which is introduced to the argon column top condenser to form a saturated vapor. This vapor is then introduced to the lower pressure column. The portion of the kettle liquid not vaporized by being processed in the argon column top condenser is introduced to the lower pressure column above the point where the vaporized kettle is added. This creates a unique distillation zone within the upper column.

In conventional practice, generally all the kettle liquid is introduced to the argon condenser and is partially vaporized. The liquid and vapor streams withdrawn from the argon column top condenser enter the lower pressure column at the same point since they are in equilibrium. It is not possible to create the additional distillation zone when the kettle liquid and vapor fractions are in equilibrium since no compositional driving force for separation exists. The additional distillation zone in the lower pressure column of the present invention relieves composition pinches that occur in conventional systems making it possible to increase argon recovery over that attainable with conventional systems when some feed air is liquefied to accommodate the boiling of liquid oxygen at elevated pressures. Even with systems wherein only some of the kettle liquid is introduced into the argon column top condenser and some passed into the lower pressure column, the portion of the kettle liquid passed into the argon column top condenser is not completely vaporized therein. The present invention comprises the unexpected discovery that in the case wherein liquid oxygen from the column system is pressurized and vaporized against condensing feed air, maximum argon recovery is attained when substantially all of the kettle liquid passed into the argon column top condenser is vaporized and then passed into the lower pressure column.

Figure 1:
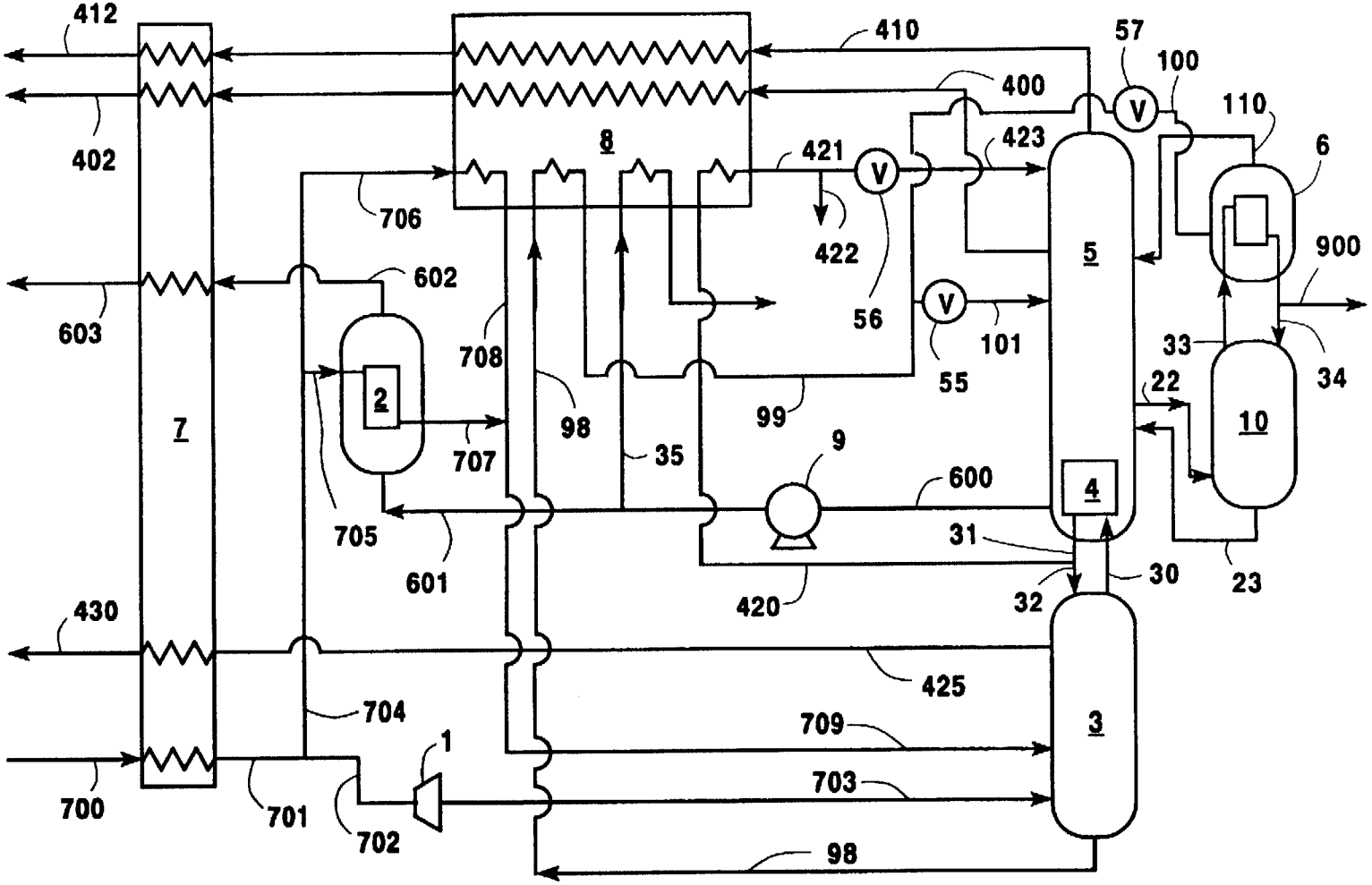
FIG. 1 is a schematic representation of one preferred embodiment of the invention wherein liquid oxygen is increased in pressure by use of a liquid pump.

The invention will be described in detail with reference to the Drawings. Referring now to FIG. 1, feed air 700, which has been cleaned of high boiling impurities such as water vapor and carbon dioxide and which is at a pressure generally within the range of from 65 to 250 pounds per square inch absolute (psia), is cooled by indirect heat exchange with return streams in main heat exchanger 7. Resulting cooled stream 701 is divided into portion 702, which comprises from about 50 to 80 percent of the feed air, and into portion 704. Portion 702 is turboexpanded by passage through turboexpander 1 and turboexpanded feed air 703 is passed into first or higher pressure column 3 which is part of a double column system which also comprises second or lower pressure column 5. Feed air portion 704 is divided into portion 705 and into portion 706. Feed air portion 705, which comprises from about 20 to 40 percent of the feed air, is passed into product boiler 2 wherein it is at least partially condensed to form feed air stream 707. Feed air portion 706 is cooled and preferably condensed by partial traverse of heat exchanger 8 and resulting feed air stream 708 is combined with stream 707 to form stream 709 which is passed into higher pressure column 3.

Higher pressure column 3 is operating at a pressure generally within the range of from 65 to 150 psia. Within higher pressure column 3 the feed air is separated by cryogenic rectification into nitrogen-enriched vapor and oxygen-enriched liquid. Nitrogen-enriched vapor is passed in stream 30 into main condenser 4 wherein it is condensed by indirect heat exchange with boiling lower pressure column 5 bottom liquid. A first portion 32 of resulting nitrogen-enriched liquid 31 is passed into higher pressure column 3 as reflux. A second portion 420 of nitrogen-enriched liquid 31 is subcooled by partial traverse of heat exchanger 8 and resulting stream 421 is passed into lower pressure column 5 as reflux. If desired, a portion of the nitrogen-enriched liquid may be recovered as product liquid nitrogen such as is shown by stream 422 with the remainder passed through valve 56 and into lower pressure column 5 as stream 423. Some nitrogen-enriched vapor may be withdrawn from higher pressure column 3 as stream 425, warmed by passage through main heat exchanger 7, and recovered as product elevated pressure nitrogen gas in stream 430.

Oxygen-enriched liquid has an oxygen concentration generally within the range of from 30 to 60 mole percent. Oxygen-enriched liquid is withdrawn from the lower portion of higher pressure column 3 in stream 98 and subcooled by partial traverse of heat exchanger 8. Resulting oxygen-enriched liquid 99 is divided into first portion 101, generally comprising from about 20 to 80 percent of the oxygen-enriched liquid, and into second portion 100, generally comprising from about 80 to 20 percent of the oxygen-enriched liquid. First oxygen-enriched liquid portion 101 is passed through valve 55 and into lower pressure column 5.

A stream 22, generally comprising from about 4 to 25 mole percent argon with the remainder being mostly oxygen, is passed from lower pressure column 5 into argon column 10 wherein it is separated by cryogenic rectification into argon-richer vapor and oxygen-richer liquid. Oxygen-richer liquid is withdrawn from argon column 10 as stream 23 and passed into lower pressure column 5. Argon-richer vapor 33 is passed into argon column top condenser 6 wherein it is condensed by indirect heat exchanger with oxygen-enriched liquid 5 second portion 100 which has been passed into top condenser 6 through valve 57. Resulting argon-richer liquid 34 is passed into argon column 10 as reflux. A portion of the argon-richer fluid is recovered as product argon having an argon concentration generally within the range of from 90 to 100 mole percent. The argon-richer fluid may be recovered as vapor and/or liquid. The embodiment of the invention illustrated in FIG. 1 illustrates the recovery of the argon-richer fluid as liquid in stream 900.

The second portion of the oxygen-enriched liquid is substantially completely vaporized by indirect heat exchanger with argon-richer vapor in top condenser 6 to produce oxygen-enriched vapor 110 which is passed from top condenser 6 into lower pressure column 5 below, preferably at least 1 equilibrium stage below, where first oxygen-enriched liquid portion 101 is passed into lower pressure column 5. Those skilled in the art will recognize that a small liquid drain, amounting to no more than 0.3 percent of the oxygen-enriched liquid passed into the argon column top condenser, may be withdrawn from the bottom of this top condenser for safety purposes.

Lower pressure column 5 is operating at a pressure less than that of higher pressure column 3 and generally within the range of from 15 to 35 psia. Within lower pressure column 5 the various feeds are separated by cryogenic rectification into nitrogen-rich vapor and oxygen-rich liquid. The difference in elevation between the points where streams 101 and 110 are passed into lower pressure column 5 creates an additional distillation zone within lower pressure column 5 between these two points.

The additional distillation zone provides for a transition between the zone above it and the zone below it. In the zone above it, the ratio of the flow of liquid descending to the flow of vapor rising, known as L/V, is less than 1, and typically is about 0.5. In the zone below the additional zone, the L/V is greater than 1, and typically is about 1.6. The L/V within the additional or new zone is about 1.0. The existence of this additional intermediate zone, together with its L/V of approximately 1.0, leads to lower pressure column operation that more effectively utilizes the compositional driving force provided to the column. This improves the degree of separation within the column making higher argon recovery possible.

Nitrogen-rich vapor is withdrawn from the upper portion of lower pressure column 5 in stream 410, warmed by passage through heat exchangers 8 and 71 and removed from the system is stream 412 which may be recovered in whole or in part. For product purity control purposes a waste stream 400 is withdrawn from lower pressure column 5 below where stream 410 is withdrawn from and above where stream 101 is introduced into column 5, passed through heat exchangers 8 and 7, and removed from the system in stream 402.

Oxygen-rich liquid, generally having an oxygen concentration within the range of from 98 to 99.99 mole percent, is withdrawn from the lower portion of lower pressure column 5 in stream 600 and increased in pressure to within the range of from 25 to 200 psia by passage through liquid pump 9. Pressurized oxygen-rich liquid 601 is then passed into heat exchanger or product boiler 2 wherein it is vaporized by indirect heat exchange with condensing feed air 705. Elevated pressure gaseous oxygen is withdrawn from product boiler 2 in stream 602, warmed by passage through main heat exchanger 7 and recovered as product stream 603.

If desired, a portion 35 of elevated pressure liquid oxygen 601 may be recovered as product liquid oxygen.

In the embodiment illustrated in FIG. 1, portion 35 is subcooled by partial traverse of heat exchanger 8 prior to recovery.

Figure 2:
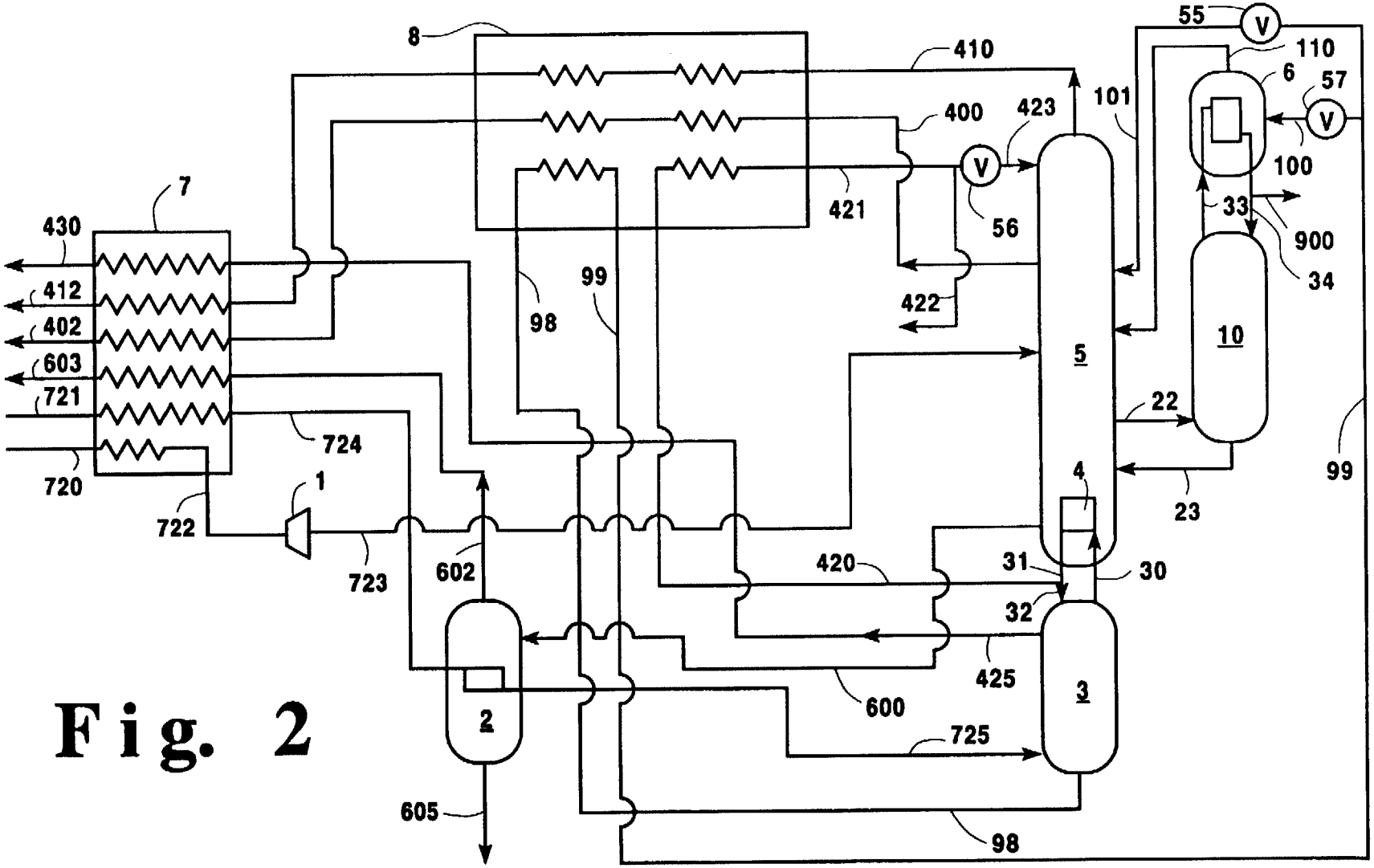
FIG. 2 is a schematic representation of another embodiment of the invention wherein the pressure of the liquid oxygen is increased by hydrostatic head.

FIG. 2 illustrates another embodiment of the invention wherein the pressure of the liquid oxygen withdrawn from the lower portion of the lower pressure column is increased by gravity. The numerals of FIG. 2 correspond to those of FIG. 1 for the common elements and these common elements will not be described again in detail.

Referring now to FIG. 2, the feed air is introduced into primary heat exchanger 7 in two streams 720 and 721. Stream 720 is withdrawn after partial traverse of heat exchanger 7 as stream 722 and turboexpanded by passage through turboexpander 1.

Resulting turboexpanded feed air stream 723 is passed into lower pressure column 5. Feed air stream 721 completely traverses heat exchanger 7 and resulting cooled feed air stream is passed into heat exchanger or product boiler 2 wherein it is at least partially condensed. Resulting feed air is withdrawn from product boiler 2 as stream 725 and passed into higher pressure column 3.

Oxygen-rich liquid in stream 600 is increased in pressure to within the range of from 20 to 25 psia by the hydrostatic head created by the difference in elevation between the bottom of lower pressure column 5 and product boiler 2. The pressurized oxygen-rich liquid is partially vaporized in product boiler 2 by indirect heat exchange with condensing feed air 724. Resulting elevated pressure gaseous oxygen is processed in a manner similar to that described in conjunction with the embodiment illustrated in FIG. 1. Remaining elevated pressure oxygen-rich liquid is withdrawn from product boiler 2 as stream 605 and recovered as elevated pressure liquid oxygen product.

Figure 3:
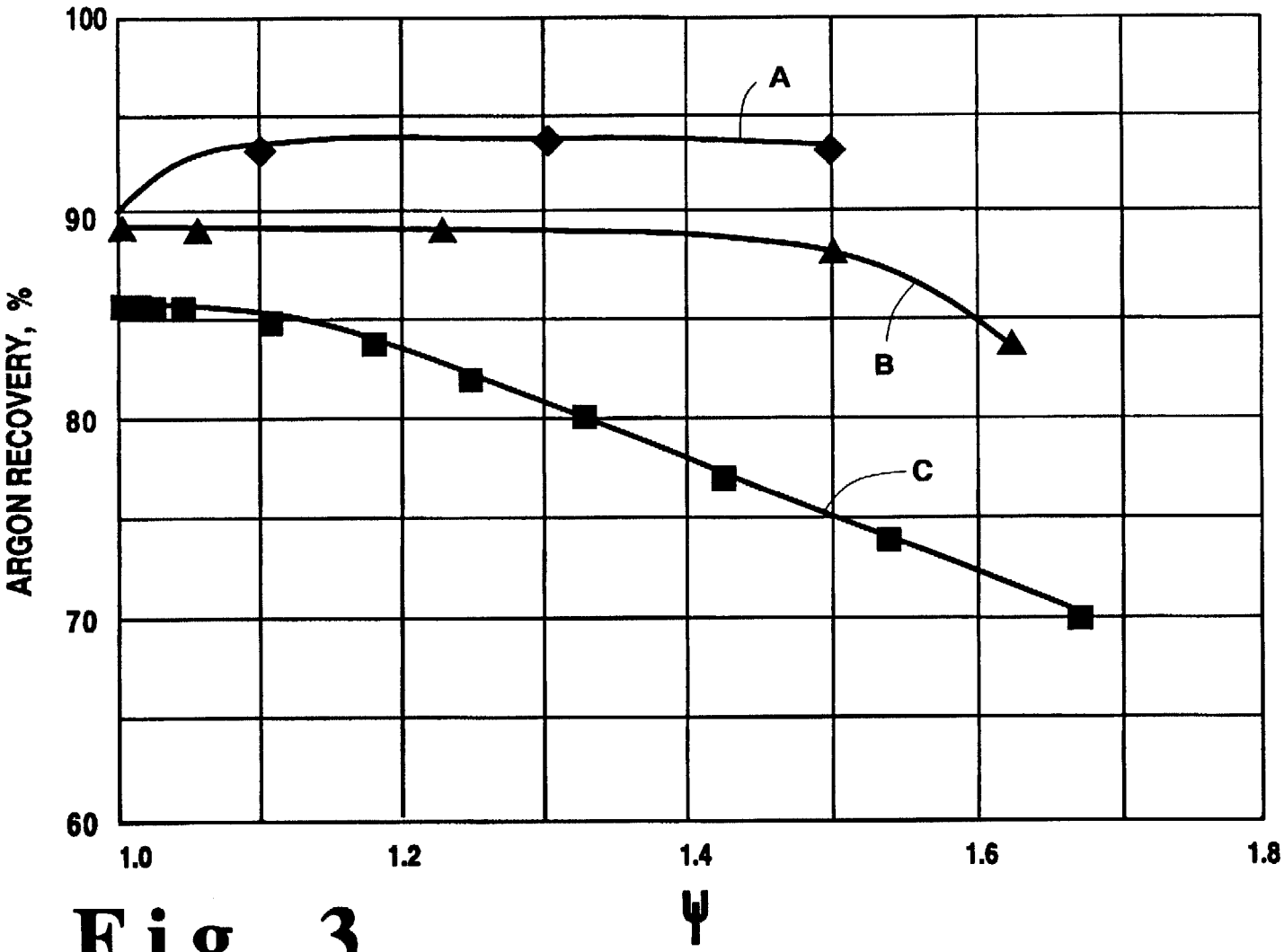
FIG. 3 is a graphical representation demonstrating the advantages of this invention compared with conventional practice.

FIG. 3 illustrates in graphical form the argon recovery for a conventional system and for the system of this invention. In FIG. 3, argon recovery in percent is shown on the vertical axis and the ratio ($\Psi$) of kettle liquid and vapor withdrawn from the argon column top condenser to the vapor withdrawn from the argon column top condenser is shown on the horizontal axis. Curve A illustrates the results of a conventional system wherein some kettle liquid is passed into the argon column top condenser and some kettle liquid is passed into the lower pressure column and wherein oxygen from the lower pressure column is not withdrawn as liquid, pressurized and vaporized against incoming air. As can be seen from FIG. 3, argon recovery for such a system is not maximized if all the kettle liquid passed into the argon column top condenser were to be vaporized, i.e. where $\Psi=1.0$. Rather, argon recovery is maximized where some kettle liquid passed into the argon column top condenser is not vaporized therein, i.e. where $\Psi$ is from about 1.1 to about 1.3. It is for this reason that conventional systems wherein kettle liquid flow is split between the lower pressure column and the argon column top condenser operate so that some fraction of the kettle liquid passed into the argon column top condenser is left unvaporized.

Curves B and C illustrate argon recovery achievable when oxygen liquid is withdrawn from the lower pressure column, pressurized and vaporized against condensing feed air. Specifically Curve B illustrates the results of the invention as carried out with the embodiment illustrated in FIG. 1 and Curve C illustrates the results of the invention as carried out with the embodiment illustrated in FIG. 2. As shown by Curves B and C of FIG. 3, when a product boiler arrangement is used to recover elevated pressure oxygen product, surprisingly and in contrast to conventional practice and expectation, argon recovery is maximized when all or substantially all of the kettle liquid passed into the argon column top condenser is vaporized, i.e. where Ψ equals 1.0.

The condensation of a portion of the feed air in the process of the present invention significantly reduces the liquid nitrogen reflux available to the top of the low pressure column as compared to known processes without the product boiler feature. This changes the composition profiles within the lower pressure column allowing increased utilization of crude liquid oxygen as reflux. In the known processes, the crude liquid oxygen reflux is mixed with a relatively larger quantity of liquid reflux descending from the top of the column. Since the top liquid has a low oxygen content, the combination of the two liquids sets up a competing effect of purity versus quantity of combined liquid that causes the process argon recovery to be maximized at an intermediate value of the Ψ ratio. However, compared to the known systems, the process of this invention achieves a maximum argon recovery when a maximum of the crude liquid oxygen is diverted directly to the lower pressure column to maximize the combined quantity of descending liquid reflux. This occurs when substantially all the oxygen to the argon condenser is vaporized, and corresponds to a value of the Ψ ratio of 1.0.

Now by the use of this invention one can efficiently produce elevated pressure gaseous oxygen by vaporizing elevated pressure liquid oxygen against condensing feed air without compromising argon recovery. Although the invention has been described in detail with reference to certain preferred embodiments, those skilled in the art will recognize that there are other embodiments of the invention within the spirit and the scope of the claims.

We claim:

1. A method for producing elevated pressure oxygen comprising:

(A) condensing feed air, passing condensed feed air into a higher pressure column, and separating feed air within the higher pressure column into nitrogen-enriched fluid and oxygen-enriched liquid;

(B) passing nitrogen-enriched fluid into a lower pressure column, passing a first portion of the oxygen-enriched liquid from the higher pressure column into the lower pressure column and producing oxygen-rich liquid within the lower pressure column;

(C) passing argon-containing fluid from the lower pressure column into an argon column and producing argon-richer vapor within the argon column;

(D) condensing the argon-richer vapor by indirect heat exchange with a second portion of the oxygen-enriched liquid from the higher pressure column which is substantially completely vaporized to produce oxygen-enriched vapor, and passing oxygen-enriched vapor into the lower pressure column below where the oxygen-enriched liquid is passed into the lower pressure column;

(E) withdrawing oxygen-rich liquid from the lower pressure column, increasing the pressure of the withdrawn oxygen-rich liquid, and vaporizing the pressurized oxygen-rich liquid to condense said feed air and to produce elevated pressure oxygen; and (F) recovering elevated pressure oxygen product.

2. The method of claim 1 further comprising turboexpanding a second feed air portion and passing the turboexpanded feed air portion into at least one of the higher pressure and lower pressure columns.

3. The method of claim 1 further comprising recovering fluid from the argon column having an argon concentration within the range of from 90 to 100 mole percent.

4. The method of claim 1 wherein the oxygen-enriched vapor is passed into the lower pressure column at least 1 equilibrium stage below where the oxygen-enriched liquid is passed into the lower pressure column.

* * * * *